US009886919B2

(12) United States Patent
Zhu et al.

(10) Patent No.: US 9,886,919 B2
(45) Date of Patent: Feb. 6, 2018

(54) DRIVING DEVICE AND LIQUID CRYSTAL DISPLAY

(71) Applicant: Shenzhen China Star Optoelectronics Technology Co., Ltd., Shenzhen, Guangdong (CN)

(72) Inventors: Jiang Zhu, Guangdong (CN); Yu-Yeh Chen, Guangdong (CN); Dongsheng Guo, Guangdong (CN)

(73) Assignee: Shenzhen China Star Optoelectronics Technology Co., Ltd, Shenzhen (CN)

( * ) Notice: Subject to any disclaimer, the term of this patent is extended or adjusted under 35 U.S.C. 154(b) by 193 days.

(21) Appl. No.: 14/909,955

(22) PCT Filed: Oct. 31, 2015

(86) PCT No.: PCT/CN2015/093495

§ 371 (c)(1),
(2) Date: Feb. 3, 2016

(87) PCT Pub. No.: WO2017/045255

PCT Pub. Date: Mar. 23, 2017

(65) Prior Publication Data

US 2017/0263197 A1 Sep. 14, 2017

(30) Foreign Application Priority Data

Sep. 15, 2015 (CN) ..... 2015 1 0587211

(51) Int. Cl.
*G09G 3/36* (2006.01)
*G09G 3/20* (2006.01)

(52) U.S. Cl.
CPC ..... *G09G 3/3607* (2013.01); *G09G 3/2074* (2013.01); *G09G 3/3688* (2013.01);
(Continued)

(58) Field of Classification Search
CPC ..... G09G 3/3688; G09G 3/2074; G09G 2300/0452; G09G 2310/0289;
(Continued)

(56) References Cited

U.S. PATENT DOCUMENTS 5,986,635 A 11/1999 Naka et al.
2004/0233228 A1* 11/2004 Ota ..... G09G 3/3648 345/690

(Continued)

FOREIGN PATENT DOCUMENTS

CN 1523873 A 8/2004
CN 101437137 A 5/2009

(Continued)

*Primary Examiner* — Shaheda Abdin
(74) *Attorney, Agent, or Firm* — Andrew C. Cheng

(57) ABSTRACT

The present invention discloses a driving device and a liquid crystal display. The driving device comprises: a sequence control chip and a data driving chip, and the sequence control chip selectively receives gray scale values of pixel dots, of which an amount is a second value in the gray scale values of pixel dots, of which an amount is a first value, and sends the same to the data driving chip, wherein the data driving chip obtains the gray scale values of the pixel dots, of which the amount is the first value according to the gray scale values of the pixel dots, of which the amount is the second value, and to output the gray scale values of the pixel dots, of which the amount is the first value after interpolation to drive a liquid crystal display.

18 Claims, 3 Drawing Sheets

(52) U.S. Cl.
CPC ..... *G09G 2300/0452* (2013.01); *G09G 2310/0235* (2013.01); *G09G 2310/0286* (2013.01); *G09G 2310/0289* (2013.01); *G09G 2310/0291* (2013.01)

(58) Field of Classification Search
CPC ... G09G 2310/0286; G09G 2310/0235; G09G 2310/0291
See application file for complete search history.

(56) References Cited

U.S. PATENT DOCUMENTS

| | | | | |
|---|---|---|---|---|
| 2006/0139272 | A1* | 6/2006 | Choi ..... | G09G 3/006 345/89 |
| 2009/0295838 | A1* | 12/2009 | Tanigawa ..... | G09G 3/3688 345/690 |
| 2010/0149148 | A1 | 6/2010 | Choe et al. | |

FOREIGN PATENT DOCUMENTS

| | | | |
|---|---|---|---|
| CN | 101442648 | A | 5/2009 |
| CN | 101959048 | A | 1/2011 |
| CN | 102647604 | A | 8/2012 |
| CN | 102685475 | A | 9/2012 |
| CN | 102790870 | A | 11/2012 |
| CN | 103905769 | A | 7/2014 |
| JP | H10276411 | A | 10/1998 |

* cited by examiner

DRIVING DEVICE AND LIQUID CRYSTAL DISPLAY

CROSS REFERENCE

This application claims the priority of Chinese Patent Application No. 201510587211.4, entitled "Driving device and liquid crystal display", filed on Sep. 15, 2015, the disclosure of which is incorporated herein by reference in its entirety.

FIELD OF THE INVENTION

The present invention relates to a liquid crystal display field, and more particularly to a driving device and a liquid crystal display.

BACKGROUND OF THE INVENTION

As shown in FIG. 1, one pixel dot of the traditional RGB liquid crystal display panel comprises red, green, blue, three sub pixels. Each sub pixel can have 0-255 of which 256 gray scales in total. With the gray scale combinations of various red, green, blue sub pixels, the various colors can be formed. One pixel dot of the traditional RGBW liquid crystal display panel comprises red, green, blue, white, four sub pixels. Each sub pixel can have 0-255 of which 256 gray scales in total. With the gray scale combinations of various red, green, blue, white sub pixels, the various colors can be formed.

The resolution is the total number of the pixel dots in a unit area. In the liquid crystal display filed, if in the unit area, the amount of the pixel dots of row coordinate is a, and the amount of the pixel dots of column coordinate is b, then the resolution of the liquid crystal display is a*b. The higher the resolution is, the shown image gets more real. Thus for the liquid crystal display, the promotion of the resolution is an important direction of developing the liquid crystal display. Nevertheless, with the increase of the resolution, the requirement to the sequence control chip becomes higher and higher. Once the resolution doubles, the complication degree of the sequence control chip becomes several times. Thus, it results in that the cost of the sequence control chip will correspondingly increase with several times.

SUMMARY OF THE INVENTION

The technical issue that the embodiment of the present invention solves is to provide a driving device and a liquid crystal display to realize the reduction of the complication of the sequence control chip.

The present invention provides a driving device, comprising: a sequence control chip and a data driving chip, and the sequence control chip is coupled to the data driving chip, and the sequence control chip is employed to selectively receive gray scale values of pixel dots, of which an amount is a second value in the gray scale values of pixel dots, of which an amount is a first value, and to send the same to the data driving chip, wherein both the first value and the second value are positive integers, and the first value is larger than the second value; the data driving chip is employed to receive the gray scale values of the pixel dots, of which the amount is the second value sent by the sequence control chip, and to obtain the gray scale values of the pixel dots, of which the amount is the first value according to the gray scale values of the pixel dots, of which the amount is the second value, and to output the obtained gray scale values of the pixel dots, of which the amount is the first value to drive a liquid crystal display.

Selectably, the first value is 2a*b, and the second value is a*b, or the first value is a*2, and the second value is a*b, wherein a is an amount of pixel dots of a first dimension coordinate of the liquid crystal display, and b is an amount of pixel dots of a second dimension coordinate of the liquid crystal display.

Selectably, the sequence control chip is specifically employed to receive gray scale values of pixel dots in every other line from the gray scale values of the pixel dots, of which the amount is 2a*b to obtain the gray scale values of the pixel dots, of which the amount is a*b, or to receive gray scale values of pixel dots in every other column from the gray scale values of the pixel dots, of which the amount is 2a*b to obtain the gray scale values of the pixel dots, of which the amount is a*b.

Selectably, the data driving chip is specifically employed to interpolate to obtain a gray scale value of a central pixel dot according to gray scale values of adjacent pixel dots, and to interpolate the gray scale values of the pixel dots, of which the amount is a*b into the gray scale values of the pixel dots, of which the amount is 2a*b, or to interpolate the gray scale values of the pixel dots, of which the amount is a*b into the gray scale values of the pixel dots, of which the amount is a*2b.

Selectably, the adjacent pixels are any one of pixel dots adjacent in left and right, pixel dots adjacent in upper and lower, pixel dots adjacent in four-neighborhood.

Selectably, the data driving chip is specifically employed to interpolate to obtain a gray scale value of a red sub pixel of a central pixel dot according to gray scale values of adjacent red sub pixels, and to interpolate to obtain a gray scale value of a green sub pixel of a central pixel dot according to gray scale values of adjacent green sub pixels, and to interpolate to obtain a gray scale value of a blue sub pixel of a central pixel dot according to gray scale values of adjacent blue sub pixels.

Selectably, the data driving chip is specifically employed to interpolate to obtain a gray scale value of a white sub pixel of a central pixel dot according to gray scale values of adjacent white sub pixels.

Selectably, the data driving chip comprises: a shift register, a data register, a line data latch, an adder, a level shifter, a digital to analog converter and an output buffer, wherein the shift register, the data register, the line data latch, the adder, the level shifter, the digital to analog converter and the output buffer are coupled in series, and the data register is employed to receive serial gray scale values of pixel dots sent by the sequence control chip in cooperation of the shift register, and to convert the serial gray scale values of the pixel dots into parallel gray scale values of the pixel dots, and send the same to the line data latch; the line data latch is employed to latch the parallel gray scale values of the pixel dots sent by the data register, and send the same to the adder; the adder is employed to output the parallel gray scale values of the pixel dots sent by the data register to the level shifter, and to add gray scale values of the adjacent pixels, and to take higher eight digitals of an added result to be outputted to the level shifter to be the gray scale value of the central pixel dot; the level shifter is employed to shift a voltage of the gray scale value of the pixel dot outputted by the adder, and to send the same to the digital to analog converter; the digital to analog converter is employed to convert the voltage of the shifted gray scale value of the pixel dot outputted by the level shifter into an analog signal, and send the same to the output buffer; the output buffer is employed to output the analog pixel gray scale value of the pixel dot to drive the pixel dot.

Selectably, a first input end of the adder is employed to input a gray scale value of a sub pixel of a first adjacent pixel dot, and a second input end of the adder is employed to input a gray scale value of the sub pixel of the same color of the second adjacent pixel dot, and a first output end of the adder is employed to directly output the gray scale value of the sub pixel of the first adjacent pixel, and a second output end of the adder is employed to output the gray scale value of the sub pixel of the second adjacent pixel dot, and a third output end of the adder is employed to output higher eight digitals of a sum of the gray scale value of the sub pixel of the first adjacent pixel and the gray scale value of the sub pixel of the same color of the second adjacent pixel dot.

The present invention provides a liquid crystal display, comprising a back plate and a liquid crystal panel, and the liquid crystal panel comprises a driving device, and the driving device comprises a sequence control chip and a data driving chip, and the sequence control chip is coupled to the data driving chip, and the sequence control chip is employed to selectively receive gray scale values of pixel dots, of which an amount is a second value in the gray scale values of pixel dots, of which an amount is a first value, and to send the same to the data driving chip, wherein both the first value and the second value are positive integers, and the first value is larger than the second value;

the data driving chip is employed to receive the gray scale values of the pixel dots, of which the amount is the second value sent by the sequence control chip, and to obtain the gray scale values of the pixel dots, of which the amount is the first value according to the gray scale values of the pixel dots, of which the amount is the second value, and to output the obtained gray scale values of the pixel dots, of which the amount is the first value to drive a liquid crystal display.

Selectably, the first value is 2a*b, and the second value is a*b, or the first value is a*2b, and the second value is a*b, wherein a is an amount of pixel dots of a first dimension coordinate of the liquid crystal display, and b is an amount of pixel dots of a second dimension coordinate of the liquid crystal display.

Selectably, the sequence control chip is specifically employed to receive gray scale values of pixel dots in every other line from the gray scale values of the pixel dots, of which the amount is 2a*b to obtain the gray scale values of the pixel dots, of which the amount is a*b, or to receive gray scale values of pixel dots in every other column from the gray scale values of the pixel dots, of which the amount is 2a*b to obtain the gray scale values of the pixel dots, of which the amount is a*b.

Selectably, the data driving chip is specifically employed to interpolate to obtain a gray scale value of a central pixel dot according to gray scale values of adjacent pixel dots, and to interpolate the gray scale values of the pixel dots, of which the amount is a*b into the gray scale values of the pixel dots, of which the amount is 2a*b, or to interpolate the gray scale values of the pixel dots, of which the amount is a*b into the gray scale values of the pixel dots, of which the amount is a*2b.

Selectably, the adjacent pixels are any one of pixel dots adjacent in left and right, pixel dots adjacent in upper and lower, pixel dots adjacent in four-neighborhood.

Selectably, the data driving chip is specifically employed to interpolate to obtain a gray scale value of a red sub pixel of a central pixel dot according to gray scale values of adjacent red sub pixels, and to interpolate to obtain a gray scale value of a green sub pixel of a central pixel dot according to gray scale values of adjacent green sub pixels, and to interpolate to obtain a gray scale value of a blue sub pixel of a central pixel dot according to gray scale values of adjacent blue sub pixels.

Selectably, the data driving chip is specifically employed to interpolate to obtain a gray scale value of a white sub pixel of a central pixel dot according to gray scale values of adjacent white sub pixels.

Selectably, the data driving chip comprises: a shift register, a data register, a line data latch, an adder, a level shifter, a digital to analog converter and an output buffer, wherein the shift register, the data register, the line data latch, the adder, the level shifter, the digital to analog converter and the output buffer are coupled in series, and the data register is employed to receive serial gray scale values of pixel dots sent by the sequence control chip in cooperation of the shift register, and to convert the serial gray scale values of the pixel dots into parallel gray scale values of the pixel dots, and send the same to the line data latch;

the line data latch is employed to latch the parallel gray scale values of the pixel dots sent by the data register, and send the same to the adder;

the adder is employed to output the parallel gray scale values of the pixel dots sent by the data register to the level shifter, and to add gray scale values of the adjacent pixels, and to take higher eight digitals of an added result to be outputted to the level shifter to be the gray scale value of the central pixel dot;

the level shifter is employed to shift a voltage of the gray scale value of the pixel dot outputted by the adder, and to output the same to the digital to analog converter;

the digital to analog converter is employed to convert the voltage the shifted gray scale value of the pixel dot outputted by the level shifter into an analog signal, and send the same to the output buffer;

the output buffer is employed to output the analog pixel gray scale value of the pixel dot to drive the pixel dot.

Selectably, a first input end of the adder is employed to input a gray scale value of a sub pixel of a first adjacent pixel dot, and a second input end of the adder is employed to input a gray scale value of the sub pixel of the same color of the second adjacent pixel dot, and a first output end of the adder is employed to directly output the gray scale value of the sub pixel of the first adjacent pixel, and a second output end of the adder is employed to output the gray scale value of the sub pixel of the second adjacent pixel dot, and a third output end of the adder is employed to output higher eight digitals of a sum of the gray scale value of the sub pixel of the first adjacent pixel and the gray scale value of the sub pixel of the same color of the second adjacent pixel dot.

With the embodiment of the present invention, the sequence control chip can selectively receive the gray scale value of the pixel dot of second value as receiving the gray scale values of the pixel dots of the first value, and then restore the gray scale values of the pixel dots, of which the amount is the first value with interpolation. Thus, the amount of the pixel dots which the sequence control chip needs to process is tremendously reduced, to realize the reduction of the complication of the sequence control chip and thus to reduce the cost of the sequence control chip.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Specifically, the terminologies in the embodiments of the present invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 1:
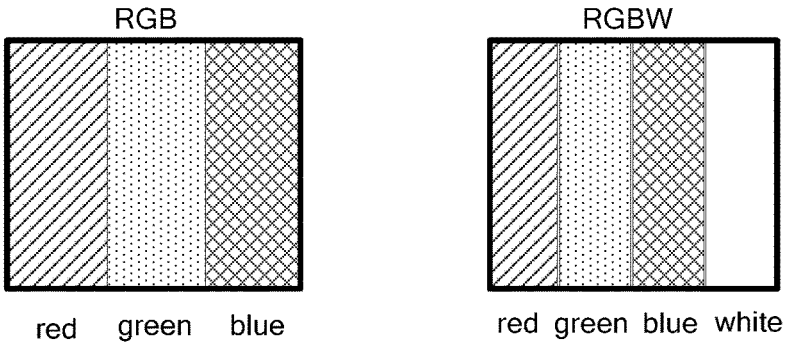
FIG. 1 is a diagram of one pixel dot of a RGB liquid crystal display and one pixel dot of a RGBW liquid crystal display.
Figure 2:
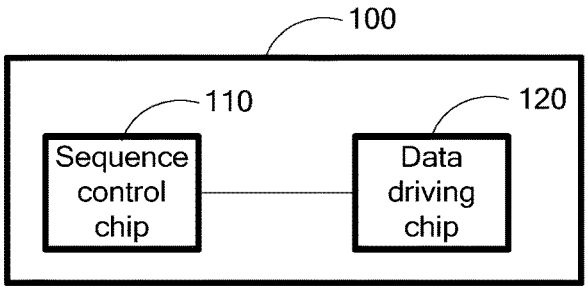
FIG. 2 is a structure diagram of a driving device according to the embodiment of the present invention.

Please refer to FIG. 2. FIG. 2 is a structure diagram of a driving device according to the embodiment of the present invention. The driving device 100 of the present invention comprises: a sequence control chip 110 and a data driving chip 120, and the sequence control chip (TCON) 110 is coupled to the data driving chip (Drive IC) 120.

Figure 3:
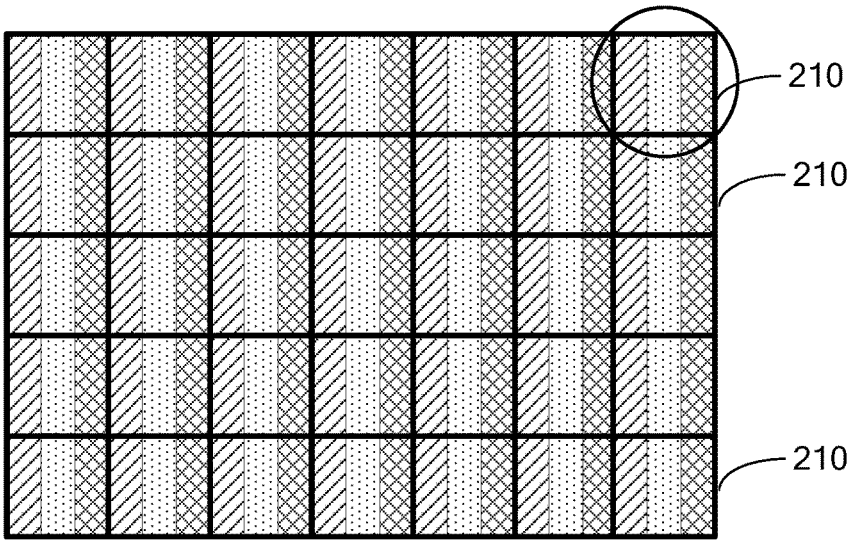
FIG. 3 is a pixel dot array diagram of a RGB liquid crystal display.

Please refer to FIG. 3 together, a liquid crystal generally comprises a plurality of pixel dots 210. When it is desired to drive the pixel dots 210 of the liquid crystal display, the grays scale values of the pixel dots, of which an amount is a first value are sent to the sequence control chip 110. The first value is a positive integer, and the first value is generally the total amount of all the pixel dots 210 of the liquid crystal display. As an illustration, if the liquid crystal display comprises 2a*b pixel dots, then the first value is 2a*b. Or, if the liquid crystal display comprises a*2b pixel dots, then the first value is a*2b, wherein a is an amount of pixel dots 210 of the horizontal coordinate of the liquid crystal display, and b is an amount of pixel dots 210 of the vertical coordinate of the liquid crystal display. For the RGB type liquid crystal display, each pixel dot 210 comprises red, green, blue, three sub pixels. Thus, the gray scale value of each pixel dot 210 comprises three gray scale values of the red, green, blue, three sub pixels for the RGB type liquid crystal display. For the RGBW type liquid crystal display, each pixel dot 210 comprises red, green, blue, white four sub pixels. Thus, the gray scale value of each pixel dot 210 comprises three gray scale values of the red, green, blue, white four sub pixels for the RGBW type liquid crystal display.

Figure 4:
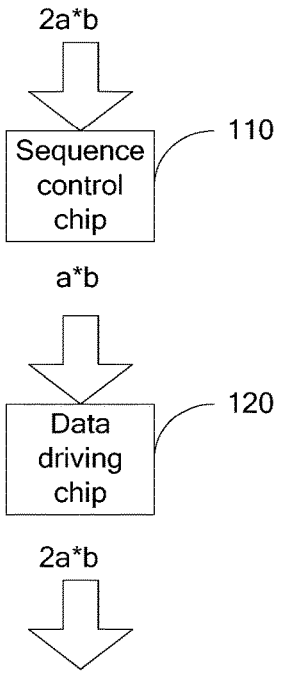
FIG. 4 is a diagram of data volume variation of a driving device through a sequence control chip and a data driving chip according to the present invention.

The sequence control chip 110 selectively receives gray scale values of pixel dots 210, of which an amount is a second value in the gray scale values of pixel dots 210, of which an amount is a first value, and sends the same to the data driving chip 120. The first value is a positive integer, and the first value is larger than the second value. Specifically, the sequence control chip 110 can selectively receive the gray scale values of pixel dots 210 in every other line, or can selectively receive the gray scale values of pixel dots 210 in every other column, or can selectively receive the gray scale values of pixel dots 210 in every three line, or can selectively receive the gray scale values of pixel dots 210 in every three column, or can selectively receive the gray scale values of pixel dots 210 in an irregular way, and no limitation is claimed here in the present invention. Please refer to FIG. 4 together. When the sequence control chip 110 selectively receives the gray scale values of pixel dots 210 in every other line, only the gray scale values of the pixel dots 210, of which the amount is a*b in the gray scale values of the pixel dots 210, of which the amount is 2a*b are received by the sequence control chip 110.

After the sequence control chip 110 sends the gray scale values of pixel dots 210, of which an amount is a second value to the data driving chip 120, the data driving chip 120 receives gray scale values of pixel dots 210, of which an amount is a second value sent by the sequence control chip 110, and obtains the gray scale values of the pixel dots 210, of which the amount is the first value according to the gray scale values of the pixel dots 210, of which the amount is the second value, and outputs the obtained gray scale values of the pixel dots 210 to drive a liquid crystal display.

Specifically, the gray scale values of the pixel dots 210, of which the amount is the first value can be obtained with interpolation. For example, the gray scale value of the central point 210 can be obtained by the interpolation of the adjacent pixel dots 210, and interpolates the gray scale values of the pixel dots 210, of which the amount is the second value into the gray scale values of the pixel dots 210, of which the amount is the first value. Specifically, the gray scale value of the central point 210 can be obtained by the interpolation of the pixel dots 210 adjacent in left and right, or the gray scale value of the central point 210 can be obtained by the interpolation of the pixel dots 210 adjacent in upper and lower, or the gray scale value of the central point 210 can be obtained by the interpolation of the pixel dots 210 adjacent in four-neighborhood to interpolate the gray scale values of the pixel dots 210, of which the amount is the second value into the gray scale values of the pixel dots 210, of which the amount is the first value. The interpolation of the data driving chip 120 corresponds to the way that the sequence control chip 110 selectively receives the pixel dots 210. As an illustration, when the sequence control chip 110 receives the gray scale values of pixel dots in every other line, the data driving chip 120 utilizes the interpolation of the gray scale values of the pixel dots 210 adjacent in upper and lower to obtain the gray scale value of the central pixel dot 210, or the interpolation of the gray scale values of the pixel dots 210 adjacent in left and right to obtain the gray scale value of the central pixel dot 210.

It is understandable that for the RGB type liquid crystal display, the gray scale value of the red sub pixel of the central pixel dot 210 can be obtained according to the interpolation of the gray scale values of the red sub pixels of the adjacent pixel dots, and the gray scale value of the green sub pixel of the central pixel dot 210 can be obtained according to the interpolation of the gray scale values of the green sub pixels of the adjacent pixel dots, and the gray scale value of the blue sub pixel of the central pixel dot 210 can be obtained according to the interpolation of the gray scale values of the blue sub pixels of the adjacent pixel dots. For the RGBW type liquid crystal display, it is further required to obtain the gray scale value of the white sub pixel of the central pixel dot 210 according to the interpolation of the gray scale values of the white sub pixels of the adjacent pixel dots.

Figure 5:
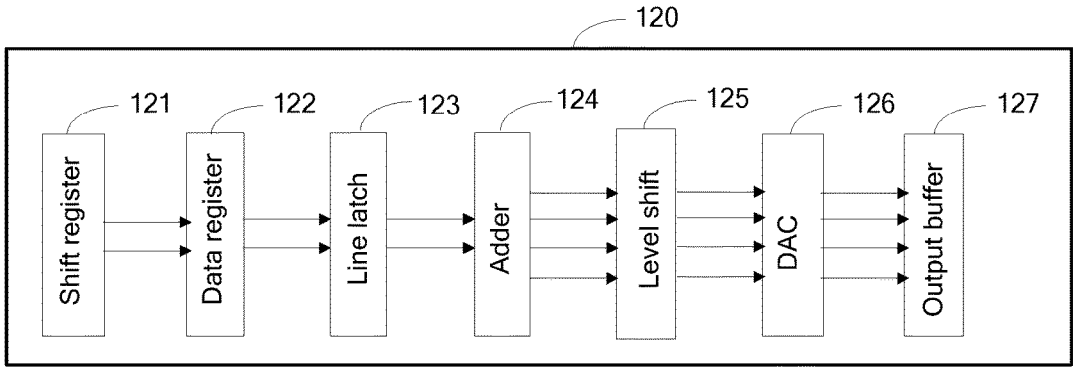
FIG. 5 is a structure diagram of a data driving chip according to the embodiment of the present invention.

The following with combination of the specific structure of the data driving chip is to explain how the interpolation is realized. Please refer to FIG. 5. The data driving chip 120 comprises a Shift register 121, a Data register 122, a Line latch 123, an Adder 124, a Level shifter 125, a DAC 126, an Output buffer 127. The Shift register 121, the Data register 122, the Line latch 123, the Adder 124, the Level shifter 125, the DAC 126, the Output buffer 127 are coupled in series.

The data register 122 is employed to receive serial gray scale values of pixel dots sent by the sequence control chip 110 in cooperation of the shift register 121, and to convert the serial gray scale values of the pixel dots into parallel gray scale values of the pixel dots, and send the same to the line data latch 123. The line data latch 123 is employed to latch the parallel gray scale values of the pixel dots sent by the data register 122, and send the same to the adder 124.

Figure 6:
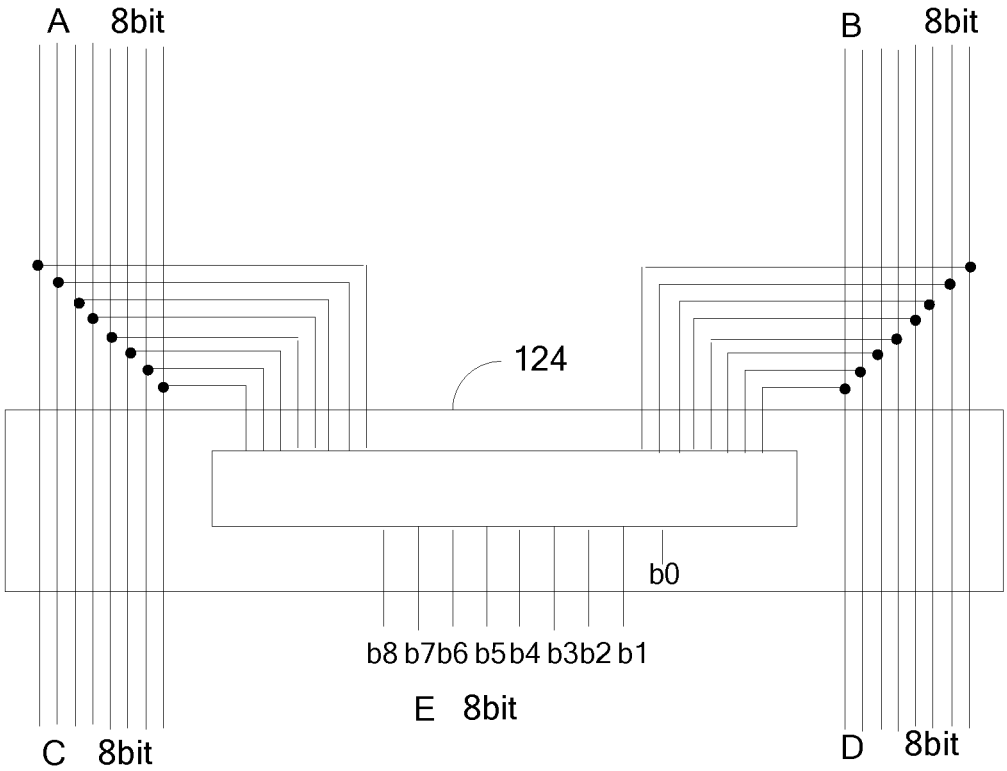
FIG. 6 is a structure diagram of an adder according to the embodiment of the present invention.

The adder 124 is employed to output the parallel gray scale values of the pixel dots sent by the data register 123 to the level shifter 125, and to add gray scale values of the adjacent pixels, and to take higher eight digitals of an added result to be outputted to the level shifter 125 to be the gray scale value of the central pixel dot. Specifically, it is illustrated that the gray scale values of the sub pixels of the pixel dots adjacent in left and right are calculated to obtain the gray scale value of the sub pixel of the central pixel dot. The structure of the adder 124 is shown in FIG. 6. The gray scale value is commonly expressed with 0-255. Thus, the first input end A of 8 digitals of the adder 124 is employed to input the gray scale value of the red sub pixel of the pixel dot adjacent in left, and the second input end A of 8 digitals of the adder 124 is employed to input the gray scale value of the red sub pixel of the pixel dot adjacent in right. The first output end C of 8 digitals of the adder 124 is employed to directly output the gray scale value of the red sub pixel of the pixel dot adjacent in left, and the second output end D of 8 digitals of the adder 124 is employed to directly output the gray scale value of the red sub pixel of the pixel dot adjacent in right. The third output end of the adder 124 is employed to output higher eight digitals of a sum of the gray scale value of the red sub pixel of the pixel dot adjacent in left and the gray scale value of the red sub pixel of the pixel dot adjacent in right. That the third output end of the adder 124 only outputs higher eight digitals of a sum of the gray scale value of the red sub pixel of the pixel dot adjacent in left and the gray scale value of the red sub pixel of the pixel dot adjacent in right is equivalent to averaging the gray scale value of the red sub pixel of the pixel dot adjacent in left and the gray scale value of the red sub pixel of the pixel dot adjacent in right. Similarly, the adder 124 can calculate and obtain the gray scale values of the green sub pixel, the blue sub pixel and the white sub pixel of the central pixel dot with the same way.

The level shifter 125 is employed to shift a voltage of the gray scale value of the pixel dot outputted by the adder 124, and to send the same to the digital to analog converter 126, and the digital to analog converter 126 is employed to convert the voltage the shifted gray scale value of the pixel dot outputted by the level shifter 125 into an analog signal, and send the same to the output buffer 127. The output buffer 127 is employed to output the analog pixel gray scale value of the pixel dot to drive the pixel dot.

With the embodiment of the present invention, the sequence control chip can selectively receive the gray scale value of the pixel dot of second value as receiving the gray scale values of the pixel dots of the first value, and then restore the gray scale values of the pixel dots, of which the amount is the first value with interpolation. Thus, the amount of the pixel dots which the sequence control chip needs to process is tremendously reduced, to realize the reduction of the complication of the sequence control chip and thus to reduce the cost of the sequence control chip.

The present invention further provides a liquid crystal display, comprising a back plate and a liquid crystal panel, and the liquid crystal panel comprises the driving device shown in FIG. 2, FIG. 4 FIG. 5 and FIG. 6. The detail specification can be referred to FIG. 2, FIG. 4 FIG. 5 and FIG. 6 and related descriptions. The repeated description is omitted here.

It is understandable in practical to the person who is skilled in the art that all or portion of the processes in the method according to the aforesaid embodiment can be accomplished with the computer program to instruct the related hardwares. The program can be stored in a readable storage medium if the computer. As the program is executed, the processes of the embodiments in the aforesaid respective methods can be included. The storage medium can be a hardisk, an optical disc, a Read-Only Memory (ROM) or a Random Access Memory (RAM).

Above are embodiments of the present invention, which does not limit the scope of the present invention. Any modifications, equivalent replacements or improvements within the spirit and principles of the embodiment described above should be covered by the protected scope of the invention.

What is claimed is:

1. A driving device, comprising a sequence control chip and a data driving chip, and the sequence control chip is coupled to the data driving chip, and the sequence control chip is employed to selectively receive gray scale values of pixel dots, of which an amount is a second value in the gray scale values of pixel dots, of which an amount is a first value, and to send the same to the data driving chip, wherein both the first value and the second value are positive integers, and the first value is larger than the second value;

the data driving chip is employed to receive the gray scale values of the pixel dots, of which the amount is the second value sent by the sequence control chip, and to obtain the gray scale values of the pixel dots, of which the amount is the first value according to the gray scale values of the pixel dots, of which the amount is the second value, and to output the obtained gray scale values of the pixel dots, of which the amount is the first value to drive a liquid crystal display.

2. The driving device according to claim 1, wherein the first value is 2a*b, and the second value is a*b, or the first value is a*2b, and the second value is a*b, wherein a is an amount of pixel dots of a first dimension coordinate of the liquid crystal display, and b is an amount of pixel dots of a second dimension coordinate of the liquid crystal display.

3. The driving device according to claim 2, wherein the sequence control chip is specifically employed to receive gray scale values of pixel dots in every other line from the gray scale values of the pixel dots, of which the amount is 2a*b to obtain the gray scale values of the pixel dots, of which the amount is a*b, or to receive gray scale values of pixel dots in every other column from the gray scale values of the pixel dots, of which the amount is 2a*b to obtain the gray scale values of the pixel dots, of which the amount is a*b.

4. The driving device according to claim 2, wherein the data driving chip is specifically employed to interpolate to obtain a gray scale value of a central pixel dot according to gray scale values of adjacent pixel dots, and to interpolate the gray scale values of the pixel dots, of which the amount is a*b into the gray scale values of the pixel dots, of which the amount is 2a*b, or to interpolate the gray scale values of the pixel dots, of which the amount is a*b into the gray scale values of the pixel dots, of which the amount is a*2b.

5. The driving device according to claim 4, wherein the adjacent pixels are any one of pixel dots adjacent in left and right, pixel dots adjacent in upper and lower, pixel dots adjacent in four-neighborhood.

6. The driving device according to claim 4, wherein the data driving chip is specifically employed to interpolate to obtain a gray scale value of a red sub pixel of a central pixel dot according to gray scale values of adjacent red sub pixels, and to interpolate to obtain a gray scale value of a green sub pixel of a central pixel dot according to gray scale values of adjacent green sub pixels, and to interpolate to obtain a gray scale value of a blue sub pixel of a central pixel dot according to gray scale values of adjacent blue sub pixels.

7. The driving device according to claim 6, wherein the data driving chip is specifically employed to interpolate to obtain a gray scale value of a white sub pixel of a central pixel dot according to gray scale values of adjacent white sub pixels.

8. The driving device according to claim 4, wherein the data driving chip comprises: a shift register, a data register, a line data latch, an adder, a level shifter, a digital to analog converter and an output buffer, wherein the shift register, the data register, the line data latch, the adder, the level shifter, the digital to analog converter and the output buffer are coupled in series, and the data register is employed to receive serial gray scale values of pixel dots sent by the sequence control chip in cooperation of the shift register, and to convert the serial gray scale values of the pixel dots into parallel gray scale values of the pixel dots, and send the same to the line data latch;

the line data latch is employed to latch the parallel gray scale values of the pixel dots sent by the data register, and send the same to the adder;

the adder is employed to output the parallel gray scale values of the pixel dots sent by the data register to the level shifter, and to add gray scale values of the adjacent pixels, and to take higher eight digitals of an added result to be outputted to the level shifter to be the gray scale value of the central pixel dot;

the level shifter is employed to shift a voltage of the gray scale value of the pixel dot outputted by the adder, and to output the same to the digital to analog converter;

the digital to analog converter is employed to convert the voltage the shifted gray scale value of the pixel dot outputted by the level shifter into an analog signal, and send the same to the output buffer;

the output buffer is employed to output the analog pixel gray scale value of the pixel dot to drive the pixel dot.

9. The driving circuit according to claim 8, wherein a first input end of the is employed to input a gray scale value of a sub pixel of a first adjacent pixel dot, and a second input end of the adder is employed to input a gray scale value of the sub pixel of the same color of the second adjacent pixel dot, and a first output end of the adder is employed to directly output the gray scale value of the sub pixel of the first adjacent pixel, and a second output end of the adder is employed to output the gray scale value of the sub pixel of the second adjacent pixel dot, and a third output end of the adder is employed to output higher eight digitals of a sum of the gray scale value of the sub pixel of the first adjacent pixel and the gray scale value of the sub pixel of the same color of the second adjacent pixel dot.

10. A liquid crystal display, comprising a back plate and a liquid crystal panel, and the liquid crystal panel comprises a driving device, and the driving device comprises a sequence control chip and a data driving chip, and the sequence control chip is coupled to the data driving chip, and the sequence control chip is employed to selectively receive gray scale values of pixel dots, of which an amount is a second value in the gray scale values of pixel dots, of which an amount is a first value, and to send the same to the data driving chip, wherein both the first value and the second value are positive integers, and the first value is larger than the second value;

the data driving chip is employed to receive the gray scale values of the pixel dots, of which the amount is the second value sent by the sequence control chip, and to obtain the gray scale values of the pixel dots, of which the amount is the first value according to the gray scale values of the pixel dots, of which the amount is the second value, and to output the obtained gray scale values of the pixel dots, of which the amount is the first value to drive a liquid crystal display.

11. The liquid crystal display according to claim 10, wherein the first value is 2a*b, and the second value is a*b, or the first value is a*2b, and the second value is a*b, wherein a is an amount of pixel dots of a first dimension coordinate of the liquid crystal display, and b is an amount of pixel dots of a second dimension coordinate of the liquid crystal display.

12. The liquid crystal display according to claim 11, wherein the sequence control chip is specifically employed to receive gray scale values of pixel dots in every other line from the gray scale values of the pixel dots, of which the amount is 2a*b to obtain the gray scale values of the pixel dots, of which the amount is a*b, or to receive gray scale values of pixel dots in every other column from the gray scale values of the pixel dots, of which the amount is 2a*b to obtain the gray scale values of the pixel dots, of which the amount is a*b.

13. The liquid crystal display according to claim 11, wherein the data driving chip is specifically employed to interpolate to obtain a gray scale value of a central pixel dot according to gray scale values of adjacent pixel dots, and to interpolate the gray scale values of the pixel dots, of which the amount is a*b into the gray scale values of the pixel dots, of which the amount is 2a*b, or to interpolate the gray scale values of the pixel dots, of which the amount is a*b into the gray scale values of the pixel dots, of which the amount is a*2b.

14. The liquid crystal display according to claim 13, wherein the adjacent pixels are any one of pixel dots adjacent in left and right, pixel dots adjacent in upper and lower, pixel dots adjacent in four-neighborhood.

15. The liquid crystal display according to claim 13, wherein the data driving chip is specifically employed to interpolate to obtain a gray scale value of a red sub pixel of a central pixel dot according to gray scale values of adjacent red sub pixels, and to interpolate to obtain a gray scale value of a green sub pixel of a central pixel dot according to gray scale values of adjacent green sub pixels, and to interpolate to obtain a gray scale value of a blue sub pixel of a central pixel dot according to gray scale values of adjacent blue sub pixels.

16. The liquid crystal display according to claim 15, wherein the data driving chip is specifically employed to interpolate to obtain a gray scale value of a white sub pixel of a central pixel dot according to gray scale values of adjacent white sub pixels.

17. The liquid crystal display according to claim 13, wherein the data driving chip comprises: a shift register, a data register, a line data latch, an adder, a level shifter, a digital to analog converter and an output buffer, wherein the shift register, the data register, the line data latch, the adder, the level shifter, the digital to analog converter and the output buffer are coupled in series, and the data register is employed to receive serial gray scale values of pixel dots sent by the sequence control chip in cooperation of the shift register, and to convert the serial gray scale values of the pixel dots into parallel gray scale values of the pixel dots, and send the same to the line data latch;

the line data latch is employed to latch the parallel gray scale values of the pixel dots sent by the data register, and send the same to the adder;

the adder is employed to output the parallel gray scale values of the pixel dots sent by the data register to the level shifter, and to add gray scale values of the adjacent pixels, and to take higher eight digitals of an added result to be outputted to the level shifter to be the gray scale value of the central pixel dot;

the level shifter is employed to shift a voltage of the gray scale value of the pixel dot outputted by the adder, and to output the same to the digital to analog converter;

the digital to analog converter is employed to convert the voltage the shifted gray scale value of the pixel dot outputted by the level shifter into an analog signal, and send the same to the output buffer;

the output buffer is employed to output the analog pixel gray scale value of the pixel dot to drive the pixel dot.

18. The liquid crystal display according to claim 17, wherein a first input end of the adder is employed to input a gray scale value of a sub pixel of a first adjacent pixel dot, and a second input end of the adder is employed to input a gray scale value of the sub pixel of the same color of the second adjacent pixel dot, and a first output end of the adder is employed to directly output the gray scale value of the sub pixel of the first adjacent pixel, and a second output end of the adder is employed to output the gray scale value of the sub pixel of the second adjacent pixel dot, and a third output end of the adder is employed to output higher eight digitals of a sum of the gray scale value of the sub pixel of the first adjacent pixel and the gray scale value of the sub pixel of the same color of the second adjacent pixel dot.

* * * * *